United States Patent [19]

Abdalla et al.

[11] Patent Number: 4,983,880

[45] Date of Patent: Jan. 8, 1991

[54] EDGE BREAKDOWN PROTECTION IN ACEL THIN FILM DISPLAY

[75] Inventors: Mohamed I. Abdalla, Beverly; Lawrence L. Hope, Maynard; Timothy Fohl, Carlisle, all of Mass.

[73] Assignee: GTE Products Corporation, Danvers, Mass.

[21] Appl. No.: 565,870

[22] Filed: Aug. 8, 1990

Related U.S. Application Data

[63] Continuation of Ser. No. 944,692, Dec. 19, 1986, abandoned.

[51] Int. Cl.[5] ..... H05B 33/22

[52] U.S. Cl. ..... 313/506; 313/509

[58] Field of Search ..... 313/506, 509, 505, 512; 428/690, 917

[56] References Cited

U.S. PATENT DOCUMENTS

| | | | |
|---|---|---|---|
| 2,922,076 | 1/1960 | Sack, Jr. et al. | 313/509 X |
| 4,042,854 | 8/1977 | Luo et al. | 313/509 X |
| 4,369,393 | 1/1983 | Frame | 313/509 X |
| 4,442,136 | 4/1984 | Johnson | 313/509 X |
| 4,757,235 | 7/1988 | Nunomura et al. | 313/509 |

FOREIGN PATENT DOCUMENTS 111566 6/1984 European Pat. Off.

OTHER PUBLICATIONS

M. R. Miller et al., "A Large-Area Electroluminescent Display with Matrix Addressing for Full Video", SID 86 Digest, pp. 167-170 (1986).

M. I. Abdalla et al., "Yield Analysis for Electroluminescent Panel Development", SPIE vol. 526, Advances in Display Technology V, pp. 83-88 (1985).

Lawrence E. Tannas, Jr. and Douglas A. Treadway, "ACTFEL Displays", SID 82 Digest, pp. 122-123 (1982).

L. L. Hope and M. I. Abdalla, "Design Considerations for Large EL Displays", SPIE Proceedings, vol. 624 (Jan. 1986).

M. I. Abdalla and L. L. Hope, "Thin Film Electroluminescent Displays", Electronic Imaging, p. 269 (1985).

M. I. Abdalla et al., "40 cm Diagonal ACEL Display", Proceedings of the 1984 SID International Symposium, Paris, France (1984).

*Primary Examiner*—Kenneth Wieder

*Attorney, Agent, or Firm*—Martha Ann Finnegan

[57] ABSTRACT

The present invention is directed to novel AC thin film electroluminescent display devices employing a protective dielectric stripe along the edges of the transparent electrode (or conductor). In particular, the present invention is directed to an AC thin film electroluminescent display device comprising:

a multilayer stack including a first dielectric layer; a phosphor layer; and a second dielectric layer; situated on a glass substrate which includes parallel stripes of etched transparent conductors;

said multilayer stack further including a protective stripe of dielectric material placed at least along the edges of the transparent conductors.

The present invention is also directed to a method for protecting an AC thin film electroluminescent display device against premature breakdown at the edges of the transparent conductors. This protection is achieved by depositing a stripe of dielectric material along the edges of the transparent conductors.

11 Claims, 1 Drawing Sheet

EDGE BREAKDOWN PROTECTION IN ACEL THIN FILM DISPLAY

STATEMENT OF GOVERNMENT INTEREST

The Government of the United States of America has certain rights to this invention pursuant to Contract No. DAAK20-82-C-0400 awarded by the Department of the Army.

This is a continuation of copending application Ser. No. 06/944,692 filed on Dec. 19, 1986, now abandoned.

BACKGROUND OF THE INVENTION

Matrix AC electroluminescent (ACEL) thin film displays are usually fabricated as a multilayer stack comprising a first dielectric layer; a phosphor (e.g., ZnS:Mn) layer; and a second dielectric layer; on a glass substrate with parallel stripes of etched transparent (e.g., indium-tin-oxide or ITO) electrodes or conductors. (The terms "conductor" and "electrode" are used herein interchangably).

Successive dielectric/phosphor/dielectric thin film layers are subsequently deposited to form the heart of the electroluminescent display. Aluminum metal electrodes are finally deposited and etched into parallel stripes orthogonal to the transparent conductor stripes to complete the thin film structure of the ACEL display.

For matrix displays, the front and rear electrode structures are sets of parallel lines, with the front transparent set (columns) orthogonal to the rear set (rows).

The choice of dielectric material plays a significant role in the function and reliability of the ACEL thin film display. Good dielectic constant and breakdown strength are required.

Many fabrication techniques for ACEL displays have been reported, including electron beam, sputtering, thermal evaporation, atomic layer epitaxy, or a combination of these methods.

The goal of preparing a large thin film electroluminescent panel capable of displaying a full page of text or high resolution graphics has been pursued vigorously over the past few years. See for example, M. R. Miller et al., "A Large-Area Electroluminescent Display With MAtrix Addressing for Full Video," *SID* 86 *Digest*, pp. 167–170 (1986): M. I. Abdalla et al., "Yield Analysis for Electroluminescent Panel Development," SPIE Vol. 256, *Advances in Display Technology V*, pp. 83–88 (1985); and L. E. Tannas et al., "ACTFEL Displays," *SID* 82 *Digest*, pp. 122–123 (1982).

The most important parameter for assessing a material is the density of electric charge it can hold without breaking down. The charge density at breakdown is given by the product of the static dielectric constant and the breakdown field:

$$Qbd = \epsilon E_{bd}$$

This quantity is thickness dependent. For films in the range of about 200 to 400 nm, charge density at breakdown should exceed about 3 micro coloumbs/square cm. For example, zinc sulfide will luminesce when the charge density reaches about 1.2 micro coloumbs/-square cm.

The resolution of the display, i.e., the number of lines that can be charged during a row address period is inversely proportional to the duty cycle, which is about 0.2% for a 512 line display.

At 60 Hz, the time allowed to charge all 512 rows is 16 millisec., so the time allocated for a single row is 0.2% of 16 millisec. or 32 microsec. Refresh rate must be at least 60 Hz to avoid flicker.

Below 1 kHz, luminance is linearly dependent on frequency. At higher frequencies, luminance is limited by phosphor decay time.

The stability of the electrical and optical characteristics of the device is also an area of practical concern.

One major difficulty in fabrication of ACEL displays is the precise thickness control required in depositing the complex EL stack. High rate production is particularly demanding. Film thickness variation is manifested as drive voltage variation across the panel. For practica use, film thickness should be maintained within about 12%.

Nonuniformity in operation can also occur if ITO sheet resistance is too high for the display size and resolution. The magnitude of this problem increases rapidly with display size.

All layers should be as clean as possible with minimum density of defects caused by particulate or pinholes to avoid premature breakdown. Integrity of the electrode system has a critical effect on yield. Electrode deposition procedures should provide smooth rows and columns free of shorts or opens.

Prior to the present discovery, rounded or beveled edges were employed on the ITO layer to improve step coverage, reduce electric field concentration, and to prevent breakdown at the column edges. However, in terms of edge breakdown protection, this method was inadequate. The present invention solves this problem.

SUMMARY OF THE INVENTION

The present invention is thus directed to novel AC thin film electroluminescent display devices employing a protective dielectric stripe along the edges of the transparent electrode (or conductor).

In particular, the present invention is directed to an AC thin film electroluminescent display device comprising:

a multilayer stack including a first dielectric layer; a phosphor layer; and a second dielectric layer; situated on a glass substrate which includes parallel stripes of etched transparent conductors;

said multilayer stack further including a protective stripe of dielectric material placed at least along the edges of the transparent conductors.

The present invention is also directed to a method for protecting an AC thin film electroluminescent display device against premature breakdown at the edges of the transparent conductors.

This protection is achieved by depositing a stripe of dielectric material along the edges of the transparent conductors.

DETAILED DESCRIPTION OF THE PREFERRED EMBODIMENTS

The present invention is directed to protecting electroluminescent thin film displays, particularly AC driven electroluminescent (ACEL) displays, from premature edge breakdown, and to the protected display devices.

Figure 1:
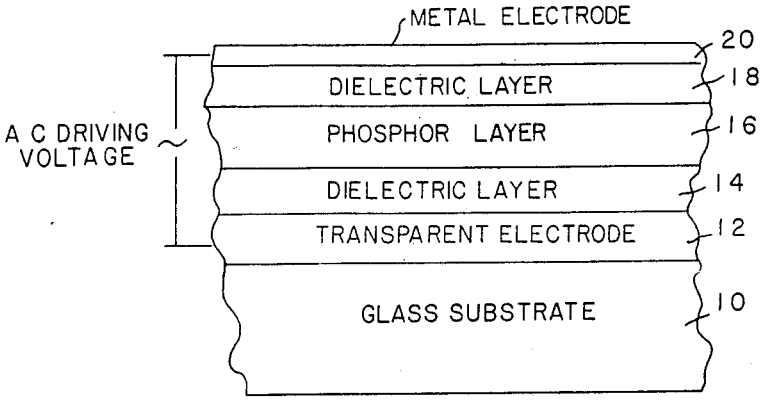
FIG. 1 PRIOR ART
Figure 1 illustrates the basic structure of an AC driven thin film electroluminescent stack.

FIG. 1 illustrates a conventional ACEL stack. The substrate 10 is typically glass. As illustrated, the first layer on the substrate is the transparent electrode (or conductor) layer 12, which is typically an ITO film of about 3000 Angstroms thickness.

Contiguous with the ITO layer is a first dielectric layer 14, which may comprise materials selected from, for example, $Y_2O_3$, $Si_3N_4$ and/or $Al_2O_3$. The phosphor layer 16 is sandwiched between the first dielectric layer 14 and the second dielectric layer 18. The phosphor layer is typically about 5000 Angstroms thick and may comprise materials such as ZnS:Mn, and the like. A metal electrode 20, such as aluminum, completes the ACEL stack.

The conventional ACEL stack shown in FIG. 1 requires a high electric field, for example, greater than about $10^6$ volts/cm to produce light. The sharp step at the etched transparent electrodes is found to be a source of electric field intensification.

Figure 2:
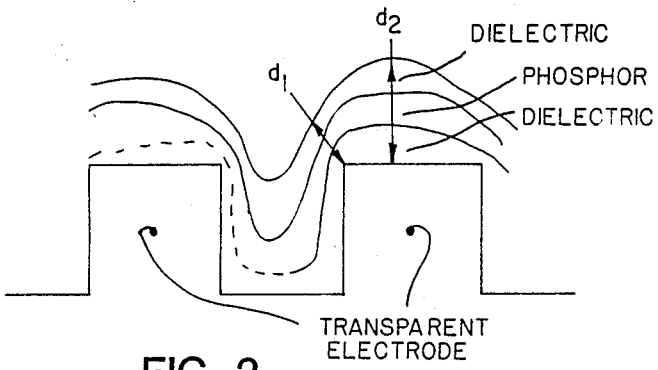
FIG. 2 PRIOR ART
FIG. 2 illustrates the electric field intensification at the edge of the transparent electrode.

This electric field intensification is thought to be due to the fact that the stack is thinner at the edges of the transparent conductor as depicted in FIG. 2. When voltage above a certain threshold value is applied, the area along the edges of the transparent conductor are found to light up first.

In view of FIG. 2, the electric field at the edge ($E_1$) may be defined by the equation:

$$E_1 = V/d_1$$

while the electric field within the pixel ($E_2$) may be defined by the equation:

$$E_2 = V/d_2$$

wherein $V/d_2$ is greater than $V/d_2$.

As illustrated in the figures $d_1$ represents the distance from the upper corner edge of the transparent electrode to the uppermost surface of the dielectric-phosphor-dielectric layer stack, and $d_2$ represents the distance from the horizontal upper surface of the transparent electrode to the uppermost surface of the dielectric-phosphor-dielectric layer stack.

Increasing the electric field across the display to achieve the required brightness level can result in a premature breakdown at the above mentioned edges. The transparent conductor column is thus permanently interrupted at the location where breakdown occurs. This results therefore, in the loss of a whole column, or part of it, and consequently reduces the quality and the overall appearance of the display.

It has been discovered that the probability of such breakdown occurring can be substantially reduced or totally eliminated by depositing a dielectric stripe along the edges of the transparent conductor.

Figure 3:
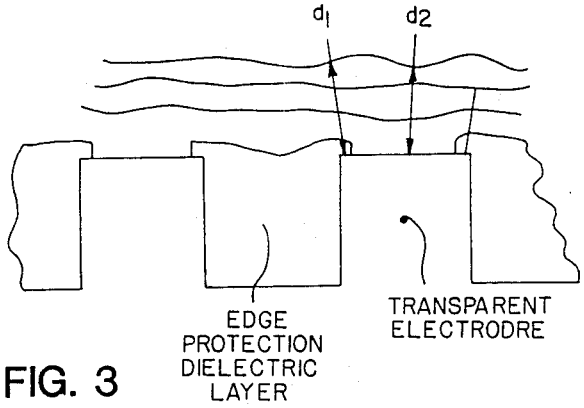
Figure 3 the effect on the electric field intensification at the transparent electrode edges when using the supplementary edge protection of the present invention (Note: it is eliminated).

One preferred example of such an edge protecting dielectric stripe is illustrated in FIG. 3.

Advantageously, the edge protecting stripe need only be placed at the position on the edges of the transparent conductors requiring such protection. It need not, for example, as illustrated in FIG. 3, fill the gap between the transparent electrodes, although if this does occur, it is not detrimental to the edge protection provided thereby.

It has further been discovered that this dielectric stripe can be made of sufficient width and thickness to reduce the value of the electric field at the edges of the transparent conductor.

In ACEL display devices of the type illustrated in FIG. 1, the "sufficient thickness" of the edge protecting dielectric stripe has been determined to range from about 200 to 1,000, preferably about 500 Angstroms. The width of the stripe need only cover the edge of the transparent conductor. In the exemplified embodiment, this translated to a width of about 7 microns. In other cases, larger or smaller widths may be necessary. In most cases, the thickness of the stripe should be sufficient to reduce the electric field at the edge, preferably between 20 to 50 percent. The width, so long as the edge is covered, does not generally effect the desired result.

For other ACEL display devices, the thickness of the edge protecting dielectric stripe may vary from the values applicable to the device of FIG. 1. However, upon consideration of the present disclosure, the skilled artisan will readily be able to determine the appropriate "sufficient thickness" for any particular application.

In addition, while the preferred dielectric material of the present invention, namely $Al_2O_3$, when employed in the FIG. 1 type ACEL display device has the "sufficient thickness" values described above, a change in dielectric material may also necessitate an appropriate adjustment in the values applicable to the "sufficient thickness" thereof. Again, based upon the present disclosure, the skilled artisan will readily be able to determine these values.

As illustrated in FIG. 3, when the edge protecting stripe of the present invention is added to the ACEL electrode edge, the following equation is satisfied:

$$E_1 \frac{(V)}{d_1} < E_2 \frac{(V)}{d_2}$$

Thus, the possibility of edge breakdown occurring under the normal ACEL display driving conditions can be totally eliminated.

The present invention will be further illustrated with reference to the following example which will aid in the understanding of the present invention, but which is not to be construed as a limitation thereof. All percentages reported herein, unless otherwise specified, are percent by weight. All temperatures are expressed in degrees Celsius.

EXAMPLE

The transparent conductor was etched into parallel stripes of about 180 microns wide. Subsequently the edge protection layer was deposited through a photomask using conventional lift off photolithography technique.

The photomask was properly aligned to cover about 166 microns of the transparent electrode, thereby leaving about 7 microns on each side of the transparent electrode to be covered by the edge protection dielectric layer.

The edge protection dielectric layer used in this case was $Al_2O_3$, which was deposited by electron beam technique to a thickness of about 500 Angstroms. The substrate was maintained at room temperature during film deposition. After depositing the edge protecting dielectric stripe, the photomask removed by dissolving it in acetone.

Subsequently the other layers were deposited, i.e., the first dielectric, the phosphor layer, the second dielectric and the rear electrode, to complete the thin film electroluminescent stack.

The present invention has been described in detail, including the preferred embodiments thereof. However, it will be appreciated that those skilled in the art, upon consideration of the present disclosure, may make modifications and/or improvements on this invention and still be within the scope and spirit of this invention as set forth in the following claims.

What is claimed is:

1. An Ac tin film electroluminescent display device comprising:

a multilayer stack including a first dielectric layer; a phosphor layer; and a second dielectric layer; situated on a glass substrate which includes parallel stripes of etched transparent conductors;

said multilayer stack further including plural protective stripes of dielectric material placed at least along the edges of the transparent conductors.

2. The AC thin film electroluminescent display device of claim 1, wherein the protective stripes of dielectric material at least partially fills the spaces between the parallel stripes of the etched transparent conductors.

3. The AC thin film electroluminescent display device of claim 2, wherein the protective stripes of dielectric material are selected from the group consisting of $Y_2O_3$, $Si_3N_4$, $Al_2O_3$, or any combination thereof.

4. The AC thin film electroluminescent display device of claim 3, wherein the protective stripes of dielectric material consist of $Al_2O_3$.

5. The AC thin film electroluminescent display device of claim 4, wherein the thickness of the protective stripes of dielectric material is from about 200 to about 1,000 Angstroms.

6. The AC thin film electroluminescent display device of claim 5, wherein the thickness of the protective stripes of dielectric material is about 500 Angstroms.

7. A method for protecting an AC thin film electroluminescent display device against premature breakdown at the edges of the transparent electrodes comprising depositing plural protective stripes of dielectric material of sufficient thickness along the edges of the transparent electrodes.

8. The method of claim 7, wherein the protective stripes of dielectric material are selected from the group consisting of $Y_2O_3$, $Si_3N_4$, $Al_2O_3$, or any combination thereof.

9. The method of claim 8, wherein the dielectric material of the protective stripes is $Al_{23}O_3$.

10. The method of claim 9, wherein the thickness of the protective dielectric stripes is from about 500 to about 1,000 Angstroms.

11. The method of claim 10, wherein the thickness of the protective dielectric stripes is about 500 Angstroms.

* * * * *